US007896199B2

(12) United States Patent
Kaczmarek

(10) Patent No.: US 7,896,199 B2
(45) Date of Patent: Mar. 1, 2011

(54) PORTABLE LIQUID-DISPENSING BAG

(76) Inventor: Daniel Steven Kaczmarek, Saint Paul, MN (US)

( * ) Notice: Subject to any disclaimer, the term of this patent is extended or adjusted under 35 U.S.C. 154(b) by 726 days.

(21) Appl. No.: 11/799,205

(22) Filed: May 1, 2007

(65) Prior Publication Data

US 2008/0272146 A1 Nov. 6, 2008

(51) Int. Cl.
*B65D 35/22* (2006.01)

(52) U.S. Cl. ..... 222/94; 222/105; 222/130; 222/146.1; 383/37; 383/47; 383/108; 383/113; 137/614.2

(58) Field of Classification Search ..... 222/94, 222/105, 129–131, 183, 146.1, 146.2, 146.6; 383/202, 37, 47, 64, 113, 108; 215/232; 137/614.2; 220/203.24
See application file for complete search history.

(56) References Cited

U.S. PATENT DOCUMENTS 2,748,047 A * 5/1956 Kuss ..... 428/137
4,196,817 A * 4/1980 Moser ..... 215/12.1
4,420,097 A * 12/1983 Motsenbocker ..... 222/131
5,145,083 A * 9/1992 Takahashi ..... 220/203.24
5,176,251 A 1/1993 Davis et al.
5,207,719 A * 5/1993 Janus ..... 224/148.2
5,230,566 A 7/1993 Jackson et al.
5,423,782 A * 6/1995 Wolrich ..... 604/339
5,833,915 A * 11/1998 Shah ..... 264/491
5,897,007 A * 4/1999 Schein et al. ..... 215/11.1
6,082,585 A * 7/2000 Mader et al. ..... 222/83
6,164,822 A * 12/2000 Beer ..... 383/38
6,220,490 B1 * 4/2001 O'Hara ..... 224/148.2
6,554,164 B1 * 4/2003 Jones ..... 222/105
6,571,977 B2 6/2003 Gonzalez et al.
6,752,264 B2 * 6/2004 Versluys ..... 206/219
6,954,969 B1 * 10/2005 Sprehe ..... 24/399
7,090,398 B2 * 8/2006 Shibata ..... 383/101
2001/0037872 A1 11/2001 Sabin
2005/0220376 A1 10/2005 Tsukanome et al.

* cited by examiner

*Primary Examiner*—Kevin Shaver
*Assistant Examiner*—Andrew Bainbridge
(74) *Attorney, Agent, or Firm*—Roger Belfay

(57) ABSTRACT

A portable, liquid-dispensing bag that has a bag within one or more bags. A fitment portal aligns openings in the one or more inner bags and outer the outer bag, which in at least one embodiment accommodates a tap. A variety of arrangements and variations are possible, including having a re-sealable opening in both the inner bag or bags and a re-sealable opening in the outer bag. A gas vent can be added to either the inner or outer bags. It is contemplated that a drinkable liquid is stored in an inner bag, and ice or cold water is stored in the outer bag to keep the drinking fluid cold.

13 Claims, 19 Drawing Sheets

PORTABLE LIQUID-DISPENSING BAG

BACKGROUND OF INVENTION

Portable heating and cooling devices are known. There are also a number of inventions aimed at providing containers which provide liquid tight seals which allow for storage of liquids, foodstuffs, or other materials to permit extended storage life for the contents.

US published utility patent application 20010037872 by Sabin, et al is typical of a class of a self-contained packet in which heating or cooling materials are enclosed in a self contained packet which can be used to heat or warm a quantity of other material without contamination of the heated or cooled material.

US Published utility patent application by 20050220376 Tsukanome, et al is typical of a class of dispensing bags having a single fill portal and is not intended for re-use.

U.S. Pat. No. 6,571,977 to Goncalez, et al is typical of a class of inventions in which the inner and outer container are both made of rigid materials to allowing for fixed volumes of material in each of the storage spaces provided within the invention.

U.S. Pat. No. 6,082,585 to Mader, et al is typical of a class of inventions in which the inner container and outer container are configured to allow fluid in the inner container to flow through the outer container for inspection or other quality assurance or preparatory purposes.

U.S. Pat. No. 5,176,251 to Davis, et al is typical of a class of inventions in which supports or separators are employed to reduce or eliminate contact between an inner and an outer container.

U.S. Pat. No. 5,230,566 to Jackson, et al is typical of a class of inventions in which the inner container is a removable liner.

U.S. Pat. No. 386,769 to Cobb, et al is typical of a class of inventions in the inner and outer containers are rigid and self supporting.

The present invention seeks to provide a dispensing bag in which will conform in shape to any object placed within the inner bag thus forming a jacket about said object. A further object of the present invention is to allow conformance with a semi-rigid or rigid free standing container in which the present invention is placed. The present invention overcomes the limitations of the aforementioned devices by providing a set of flexible bags which can be configured for a wide variety of applications.

BRIEF SUMMARY OF THE INVENTION

The portable, liquid-dispensing bag comprises a constellation of bags constructed of flexible liquid proof materials, fitment portals, and resealable openings. Each bag may have one or more re-sealable openings.

In one embodiment the portable, liquid-dispensing bag comprises a single inner bag and a single outer bag wherein both the inner bag and the outer bag are attached in a liquid-proof manner to a single fitment portal permitting flow of liquid from inside the inner bag to the outside of the outer bag. In another embodiment of the portable, liquid-dispensing bag the inner bag or bags and the outer bag are attached in a liquid proof manner to form a fitment portal 6 through which a tap or spigot of a liquid container, such as a wine box, bag or other flexible container, may pass allowing liquid from the container to be removed via the tap or spigot to the outside of the outer bag. The inner bag may or may not include one or more re-sealable openings to permit insertion of other containers, or materials as desired. The outer bag may or may not include one or more second re-sealable openings to permit insertion of other containers, or materials as desired. The inner bag and the outer bag may be composed of the same or differing materials, provided that the materials chosen are capable of being sealed to either each other to form a fitment portal or to the fitment portal in a liquid-proof manner, such as heat sealing, adhesive fastening, stretch fitting or other suitable means.

DETAILED DESCRIPTION

Figure 1:
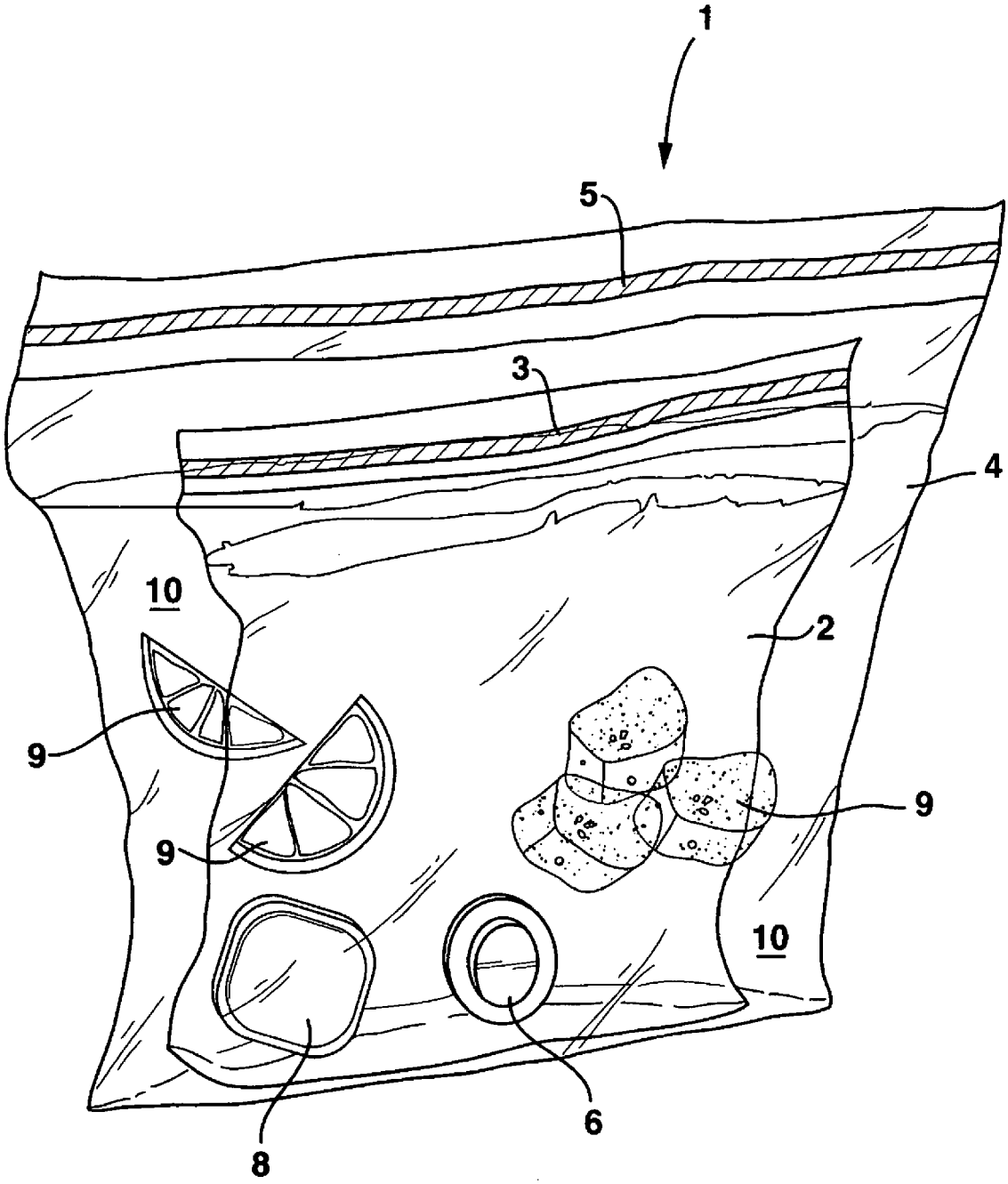
FIG. 1 is a perspective view of the portable liquid dispensing bag.
Figure 2:
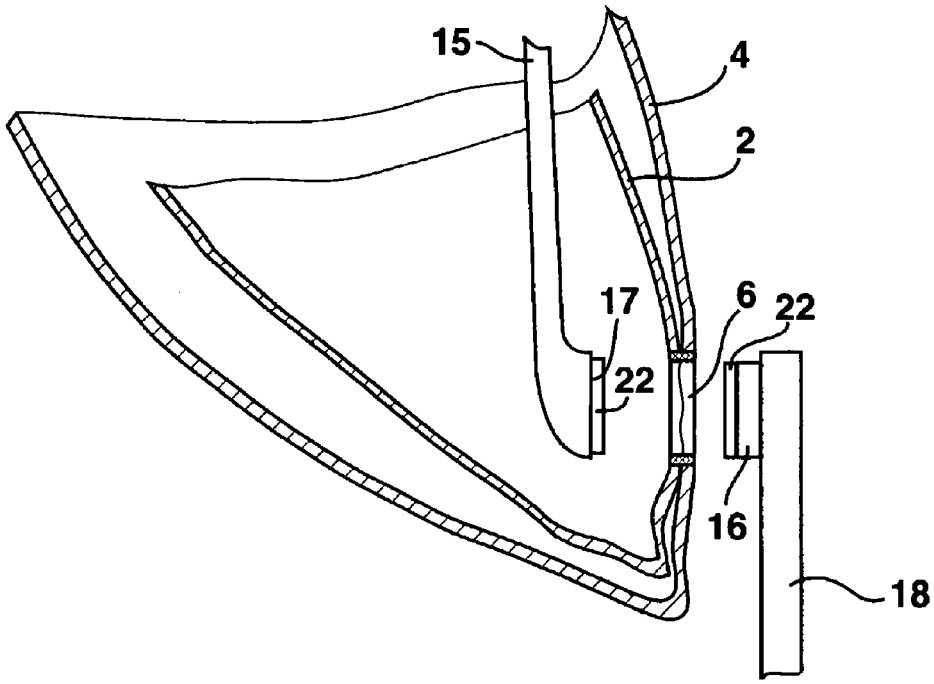
FIG. 2 is a section view of a preferred embodiment with a fused fitment portal.
Figure 3:
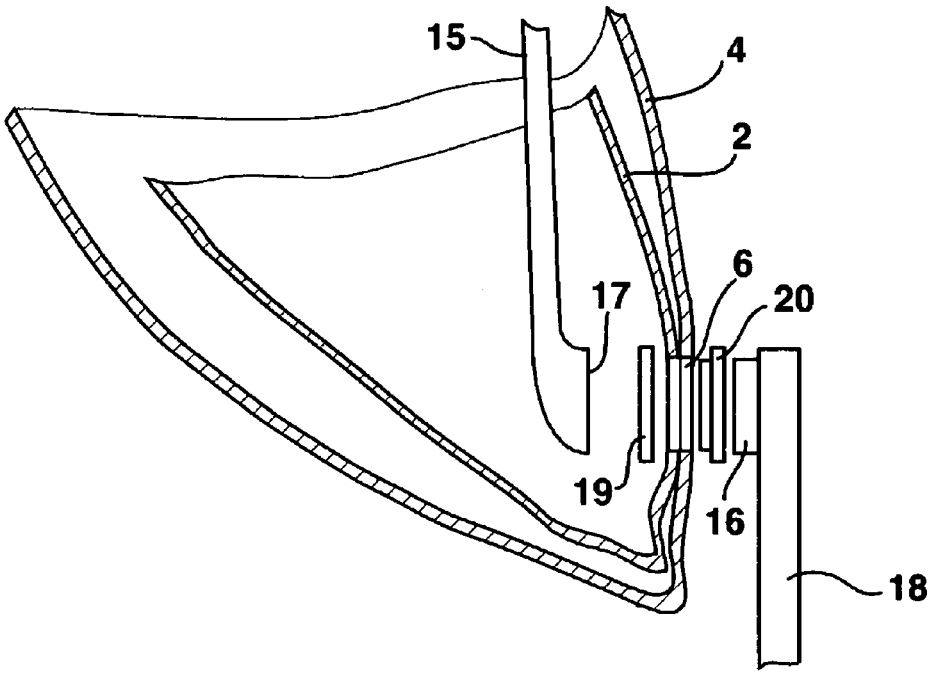
FIG. 3 is a section view of a split ring fitment portal.
Figure 4:
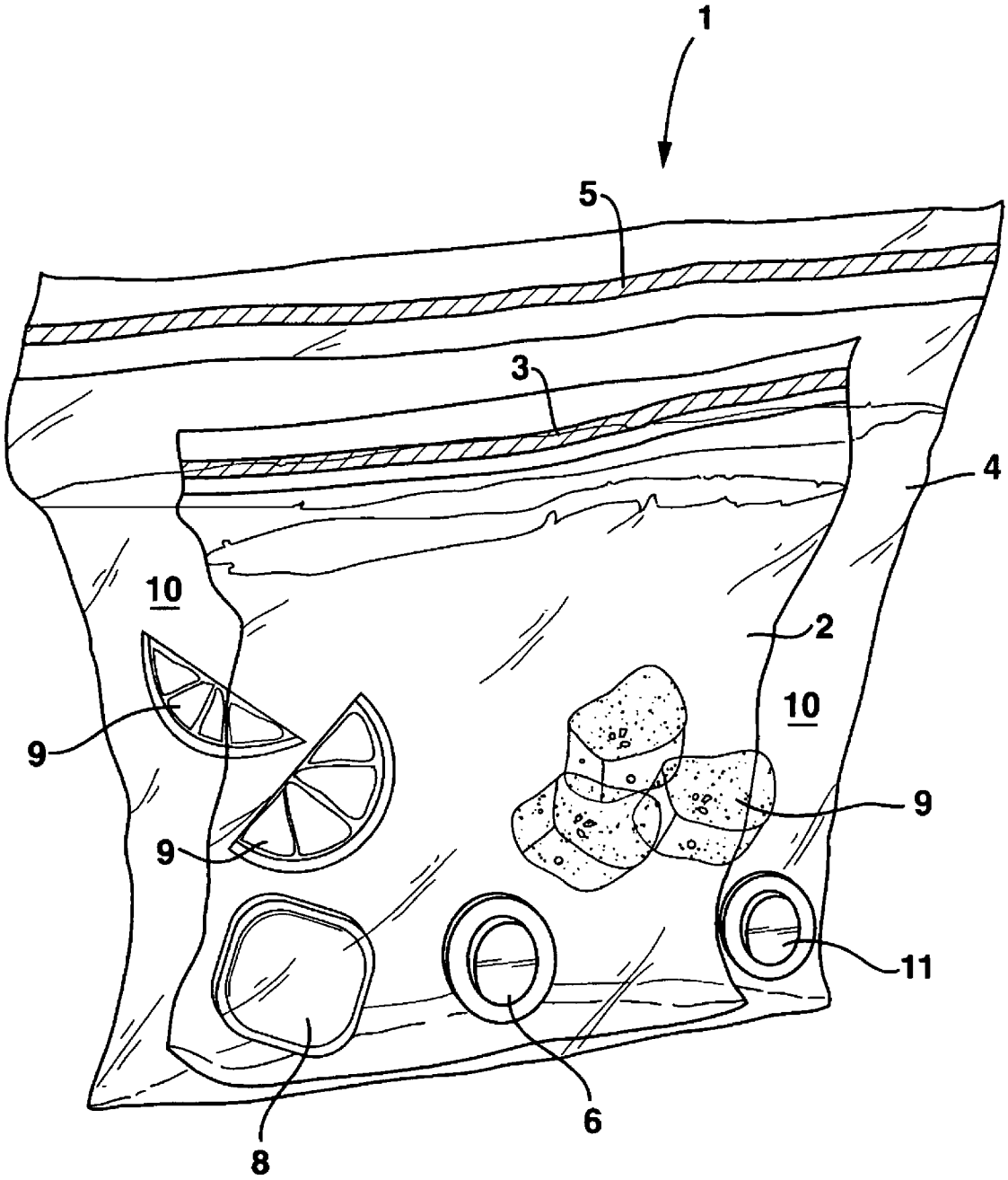
FIG. 4 is an embodiment of FIG. 1 with a second fitment portal.
Figure 5:
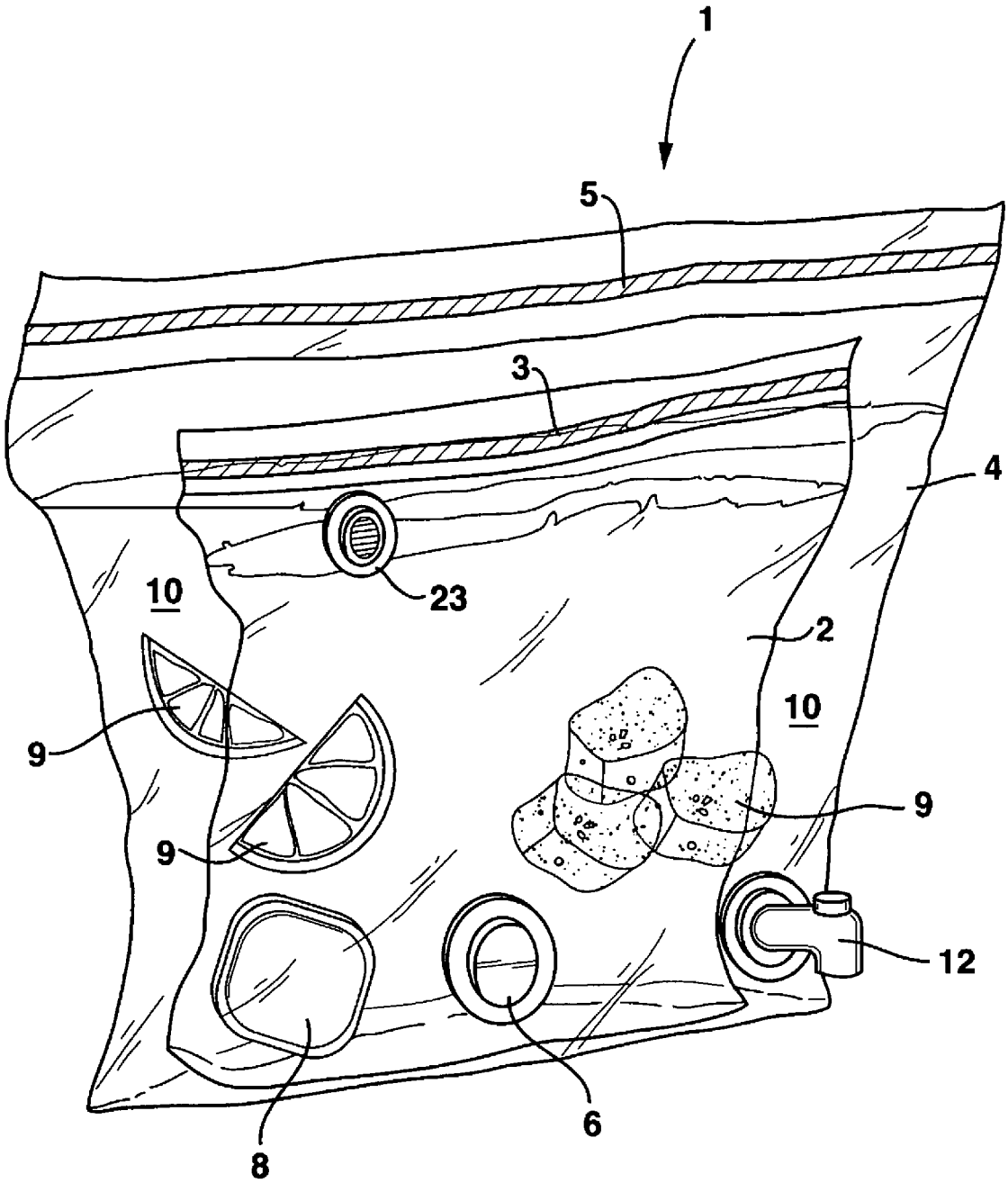
FIG. 5 is an embodiment of FIG. 1 with a tap.
Figure 6:
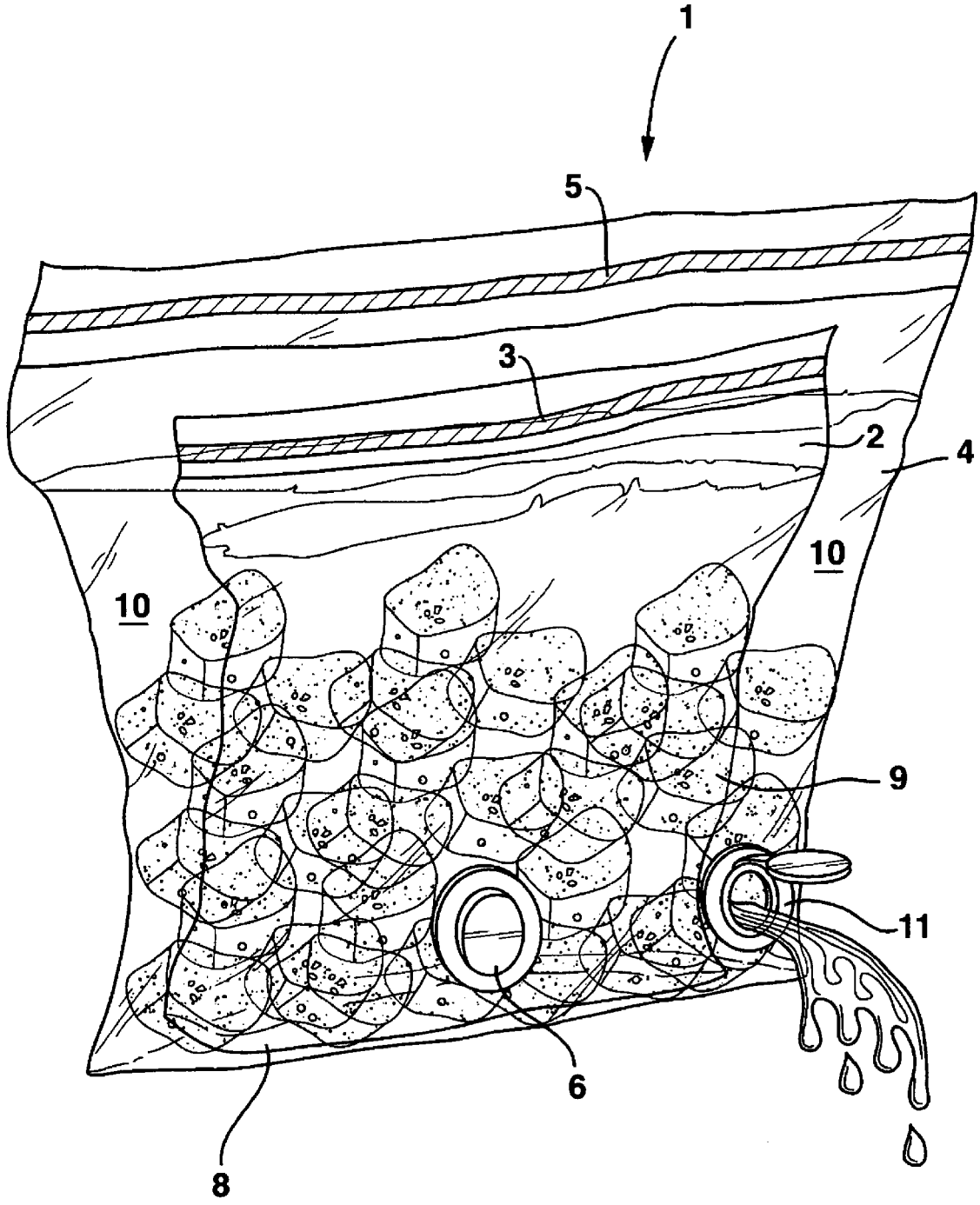
FIG. 6 is a perspective view of the portable liquid dispensing bag, dispensing liquid.
Figure 7:
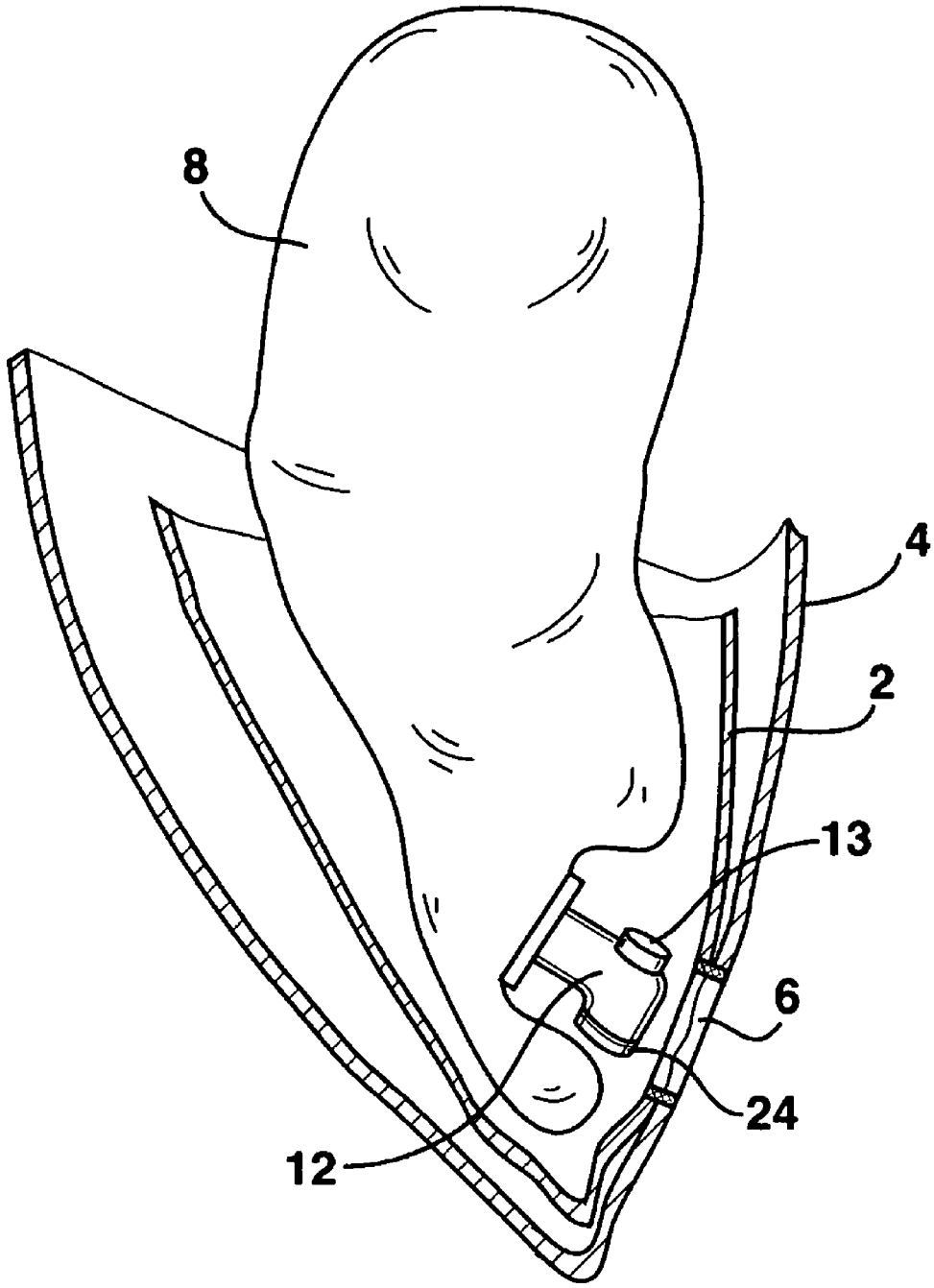
FIG. 7 is a section view of a retractable tap.
Figure 8:
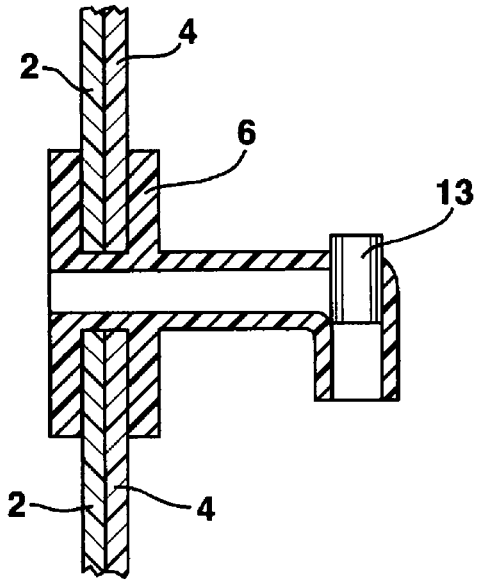
FIG. 8 is a detail view of a valve mechanism.
Figure 9:
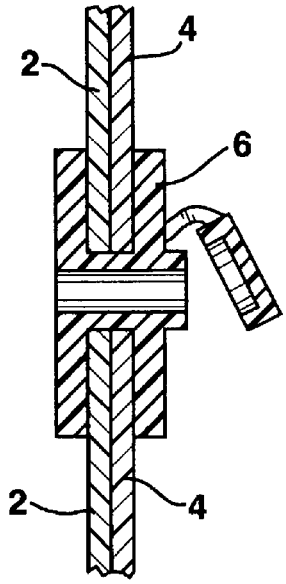
FIG. 9 is a detail view of a stopper.
Figure 10:
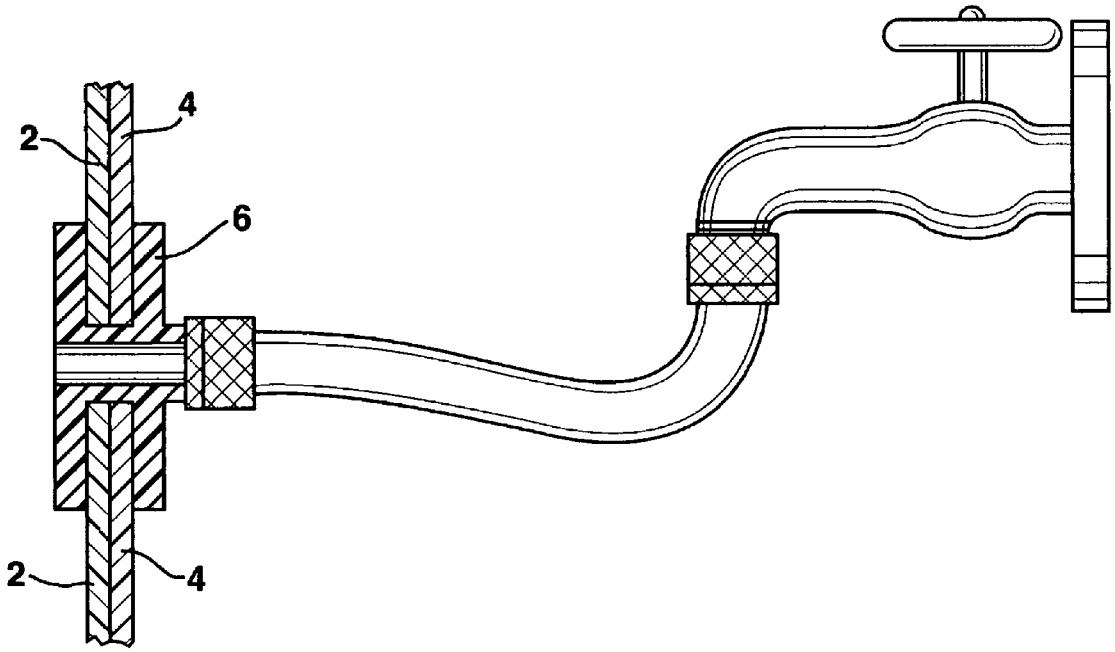
FIG. 10 is a detail view of the invention sealed to a spigot.
Figure 11:
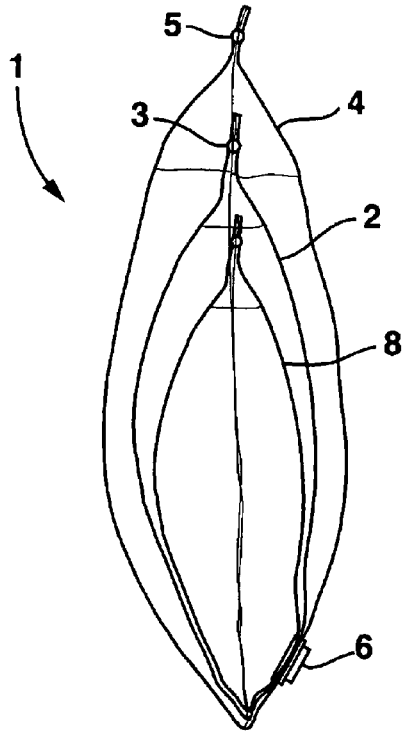
FIG. 11 is a side view of a multiple bag arrangement.
Figure 12:
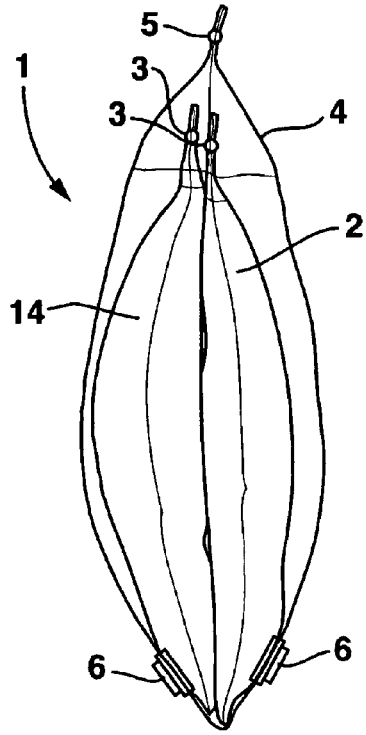
FIG. 12 is a side view of a first embodiment of two, side by side, inner bags with a fitment portal each.
Figure 13:
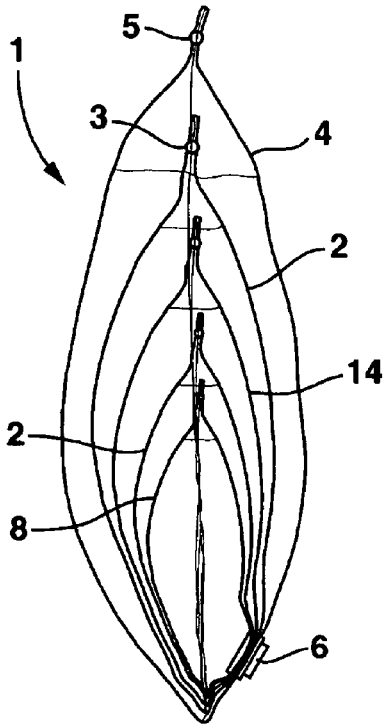
FIG. 13 is a side view of a second embodiment.
Figure 14:
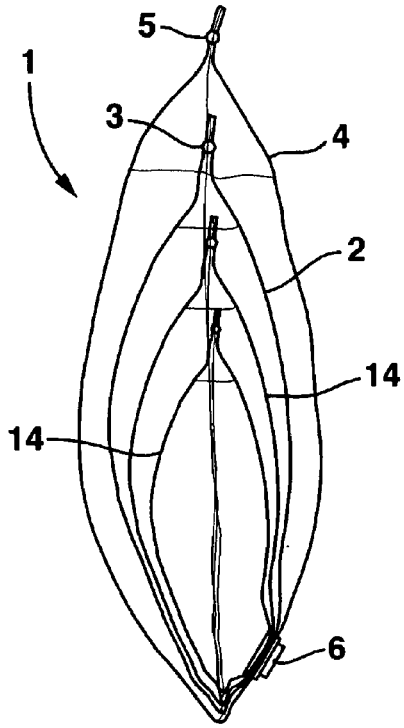
FIG. 14 is a side view of a third embodiment.
Figure 15:
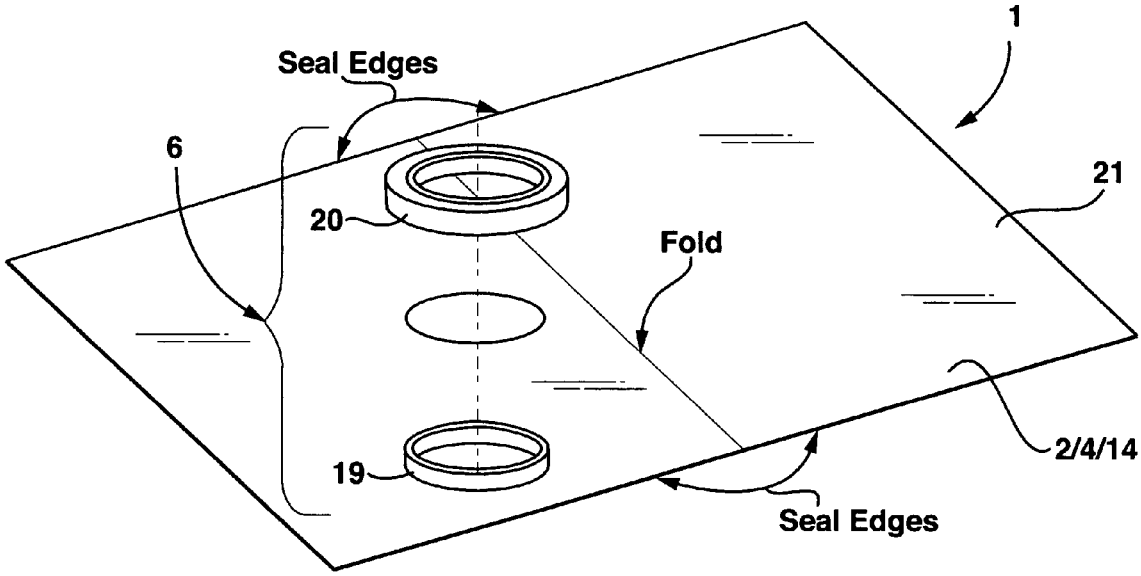
FIG. 15 is a exploded view of single sheet construction method.
Figure 16:
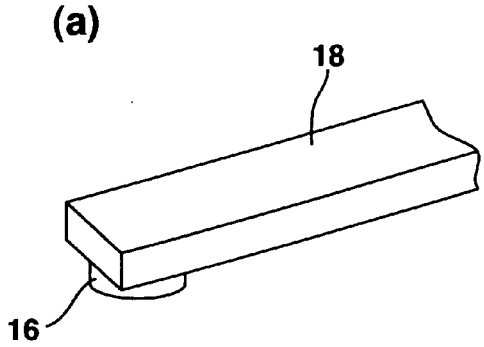
FIG. 16 is a perspective view of first method step (a).
Figure 17:
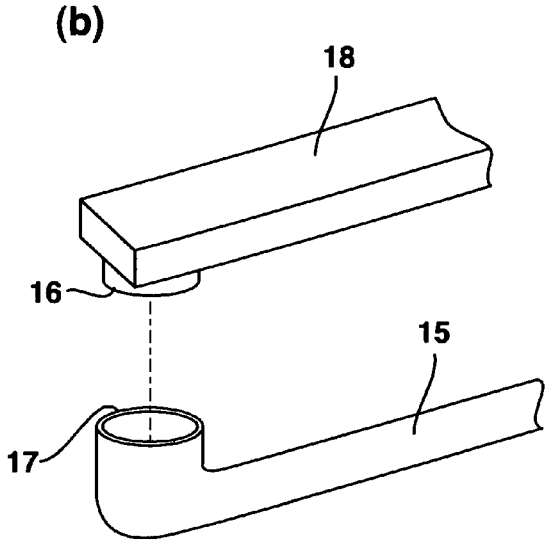
FIG. 17 is a perspective view of first method step (b).
Figure 18:
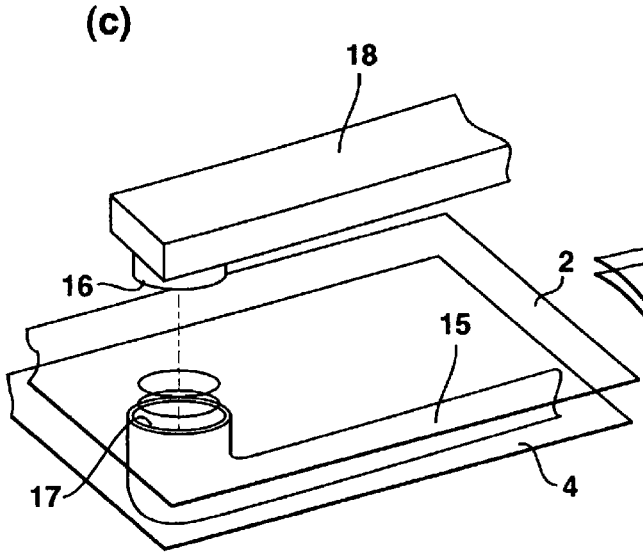
FIG. 18 is a perspective view of first method step (c).
Figure 19:
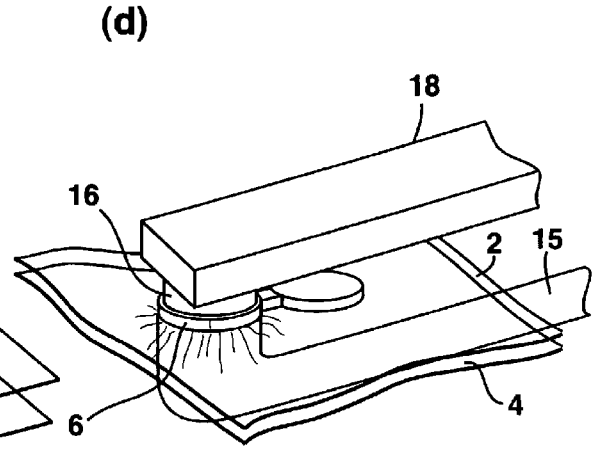
FIG. 19 is a perspective view of first method step (d).
Figure 20:
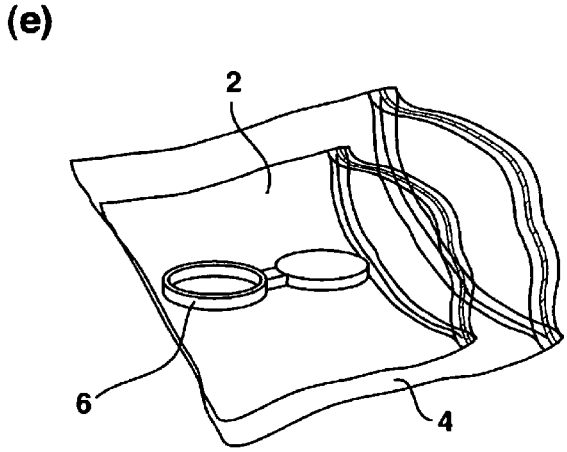
FIG. 20 is a perspective view of first method step (e).
Figure 21:
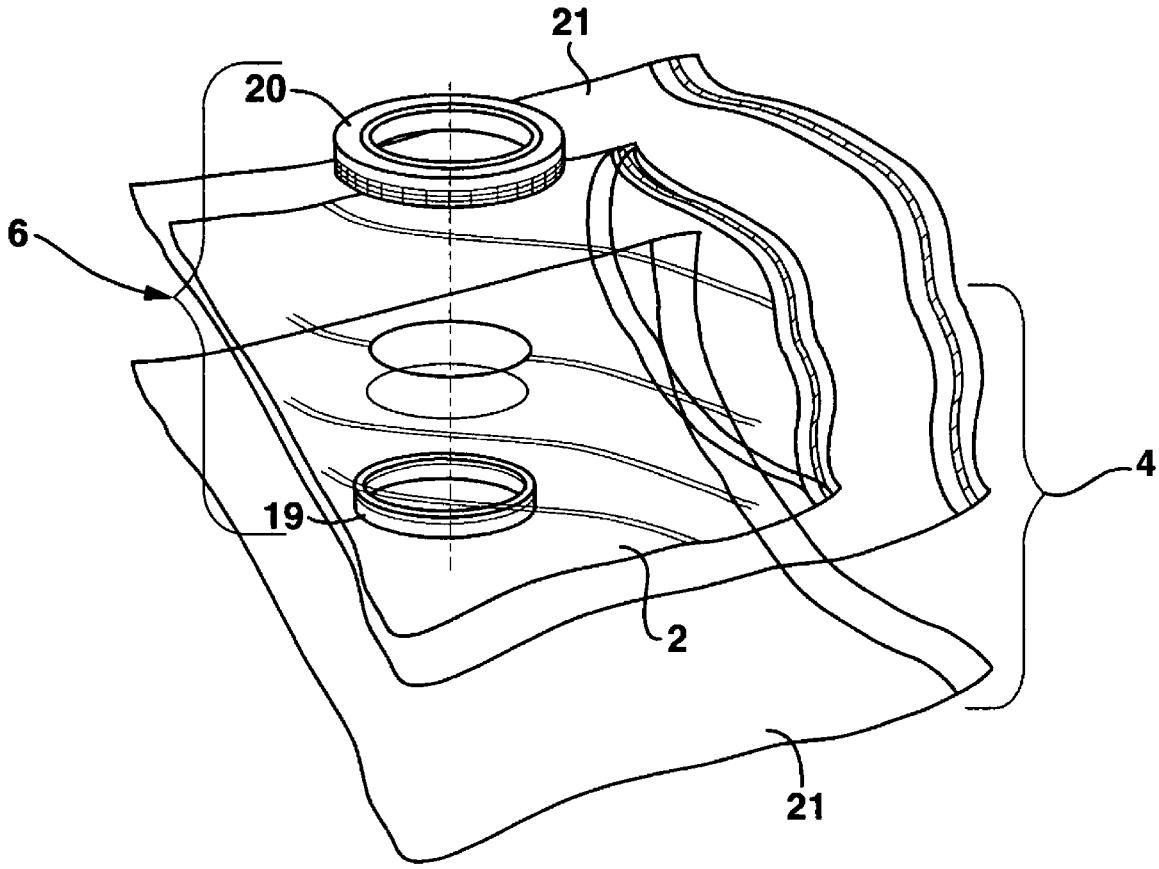
FIG. 21 is a exploded view of pre made bag construction method.
Figure 22:
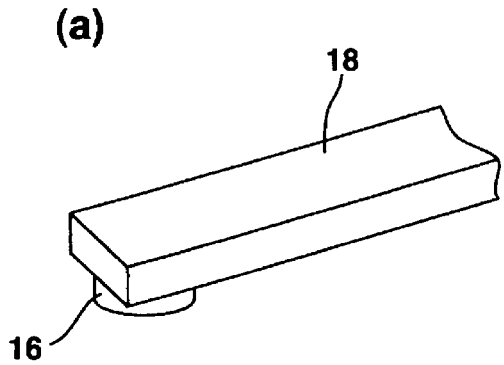
FIG. 22 is a perspective view of second method step (a).
Figure 23:
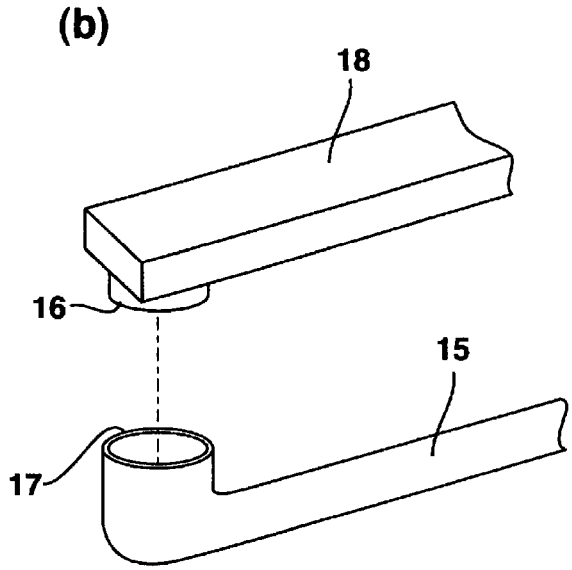
FIG. 23 is a perspective view of second method step (b).
Figure 24:
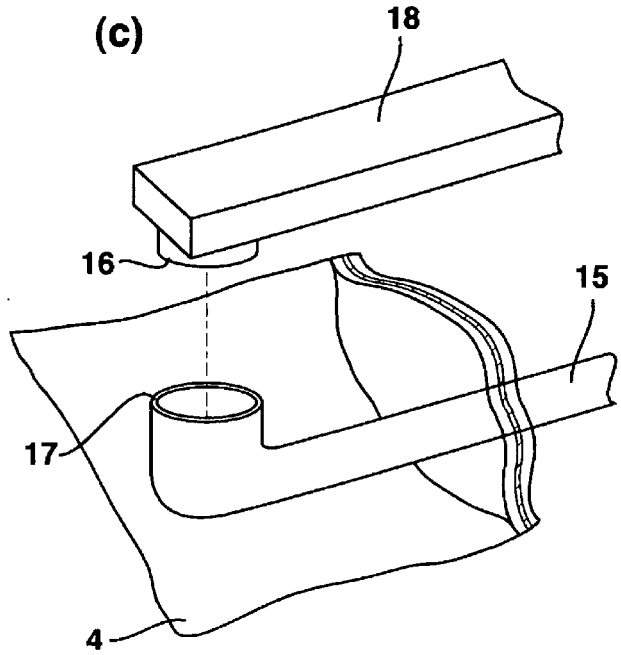
FIG. 24 is a perspective view of second method step (c).
Figure 25:
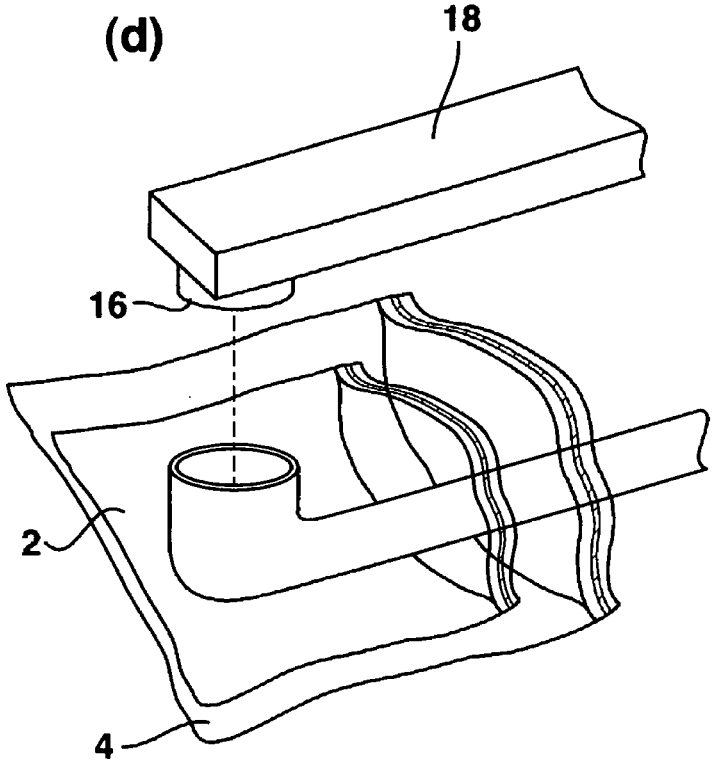
FIG. 25 is a perspective view of second method step (d).
Figure 26:
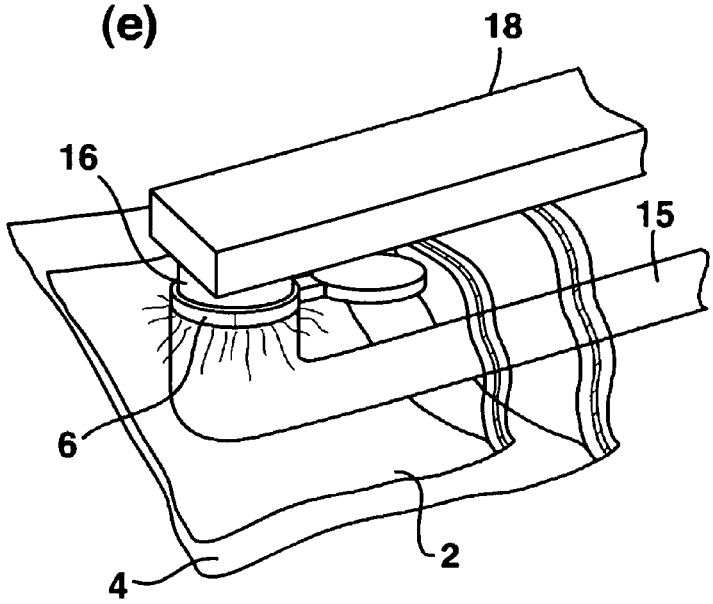
FIG. 26 is a perspective view of second method step (e).
Figure 27:
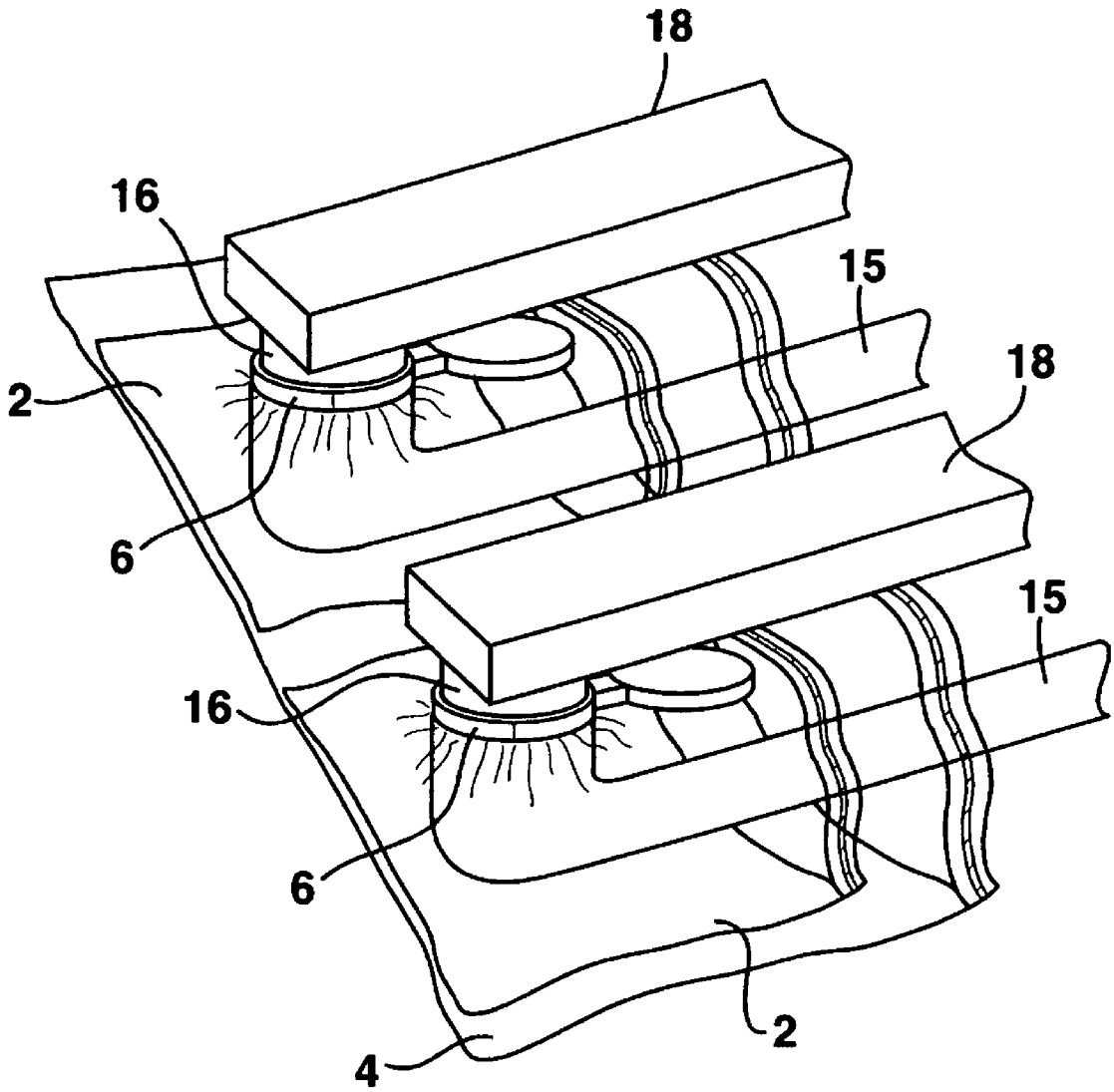
FIG. 27 is a perspective view of multiples of fitment portals being manufactured.
Figure 28:
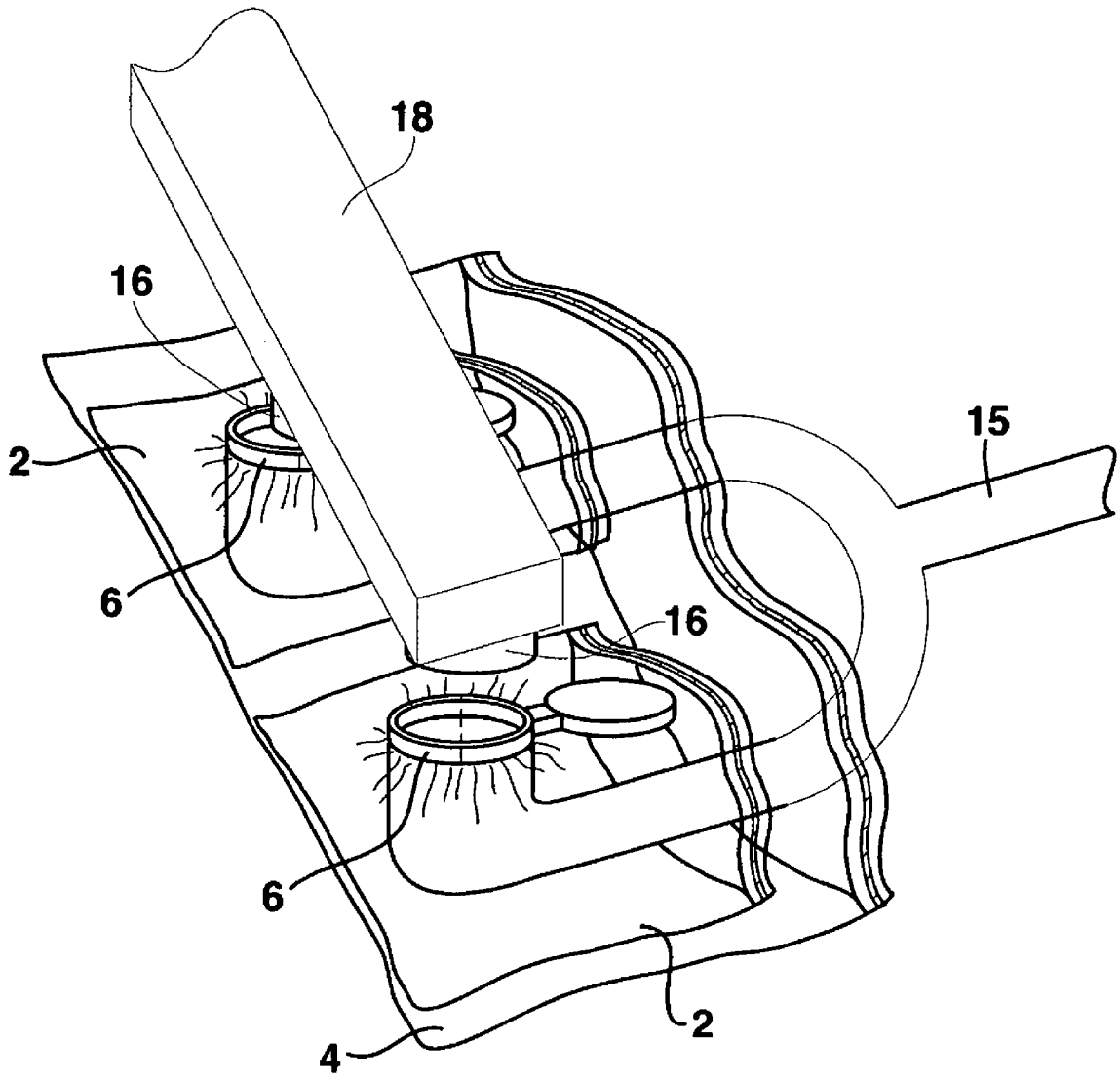
FIG. 28 is a perspective view of an embodiment showing multiple positions on one arm and base.
Figure 29:
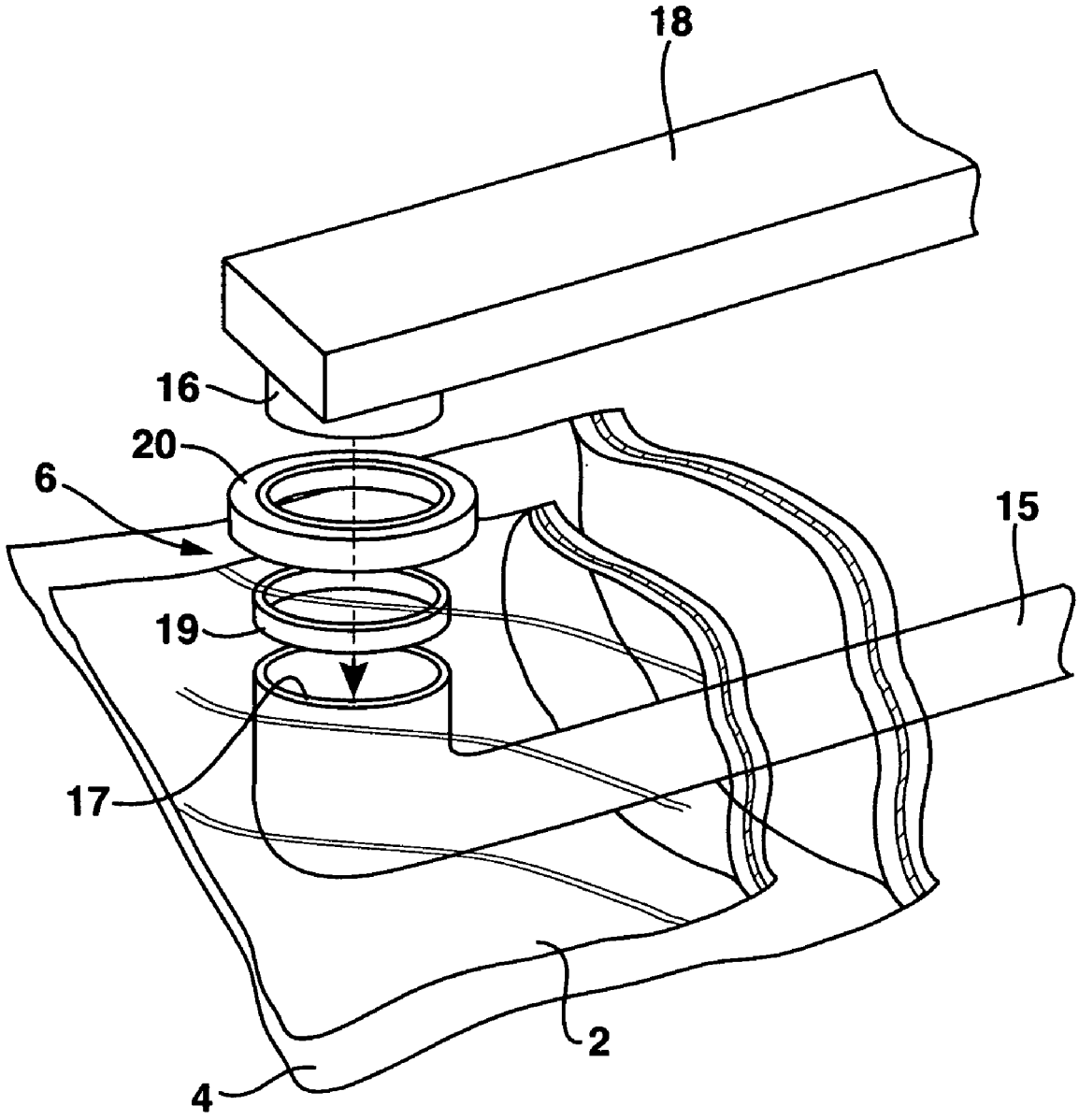
FIG. 29 is a perspective view of a split ring embodiment being manufactured.
Figure 30:
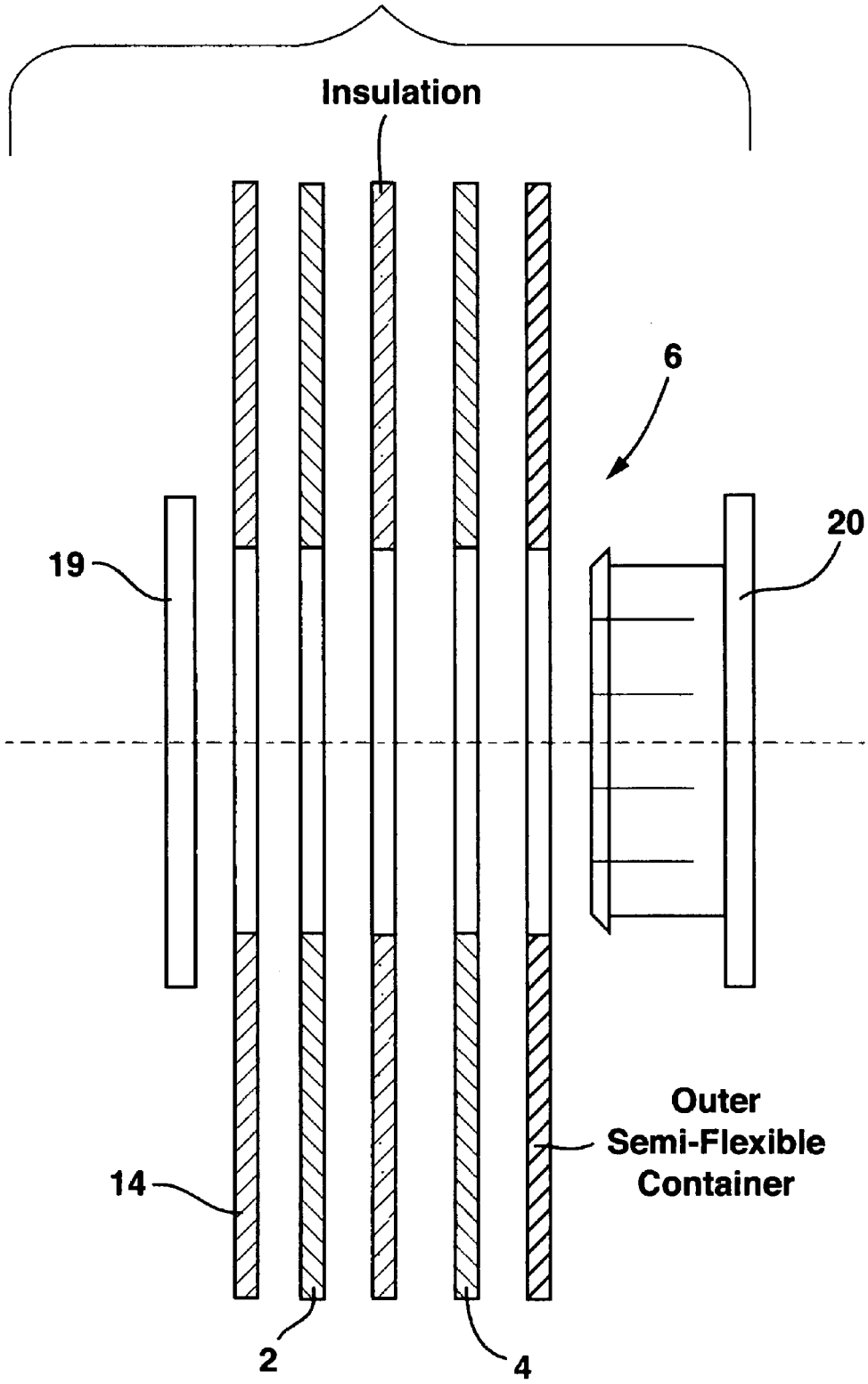
FIG. 30 is a sectional view of another split ring manufacturing embodiment.
Figure 31:
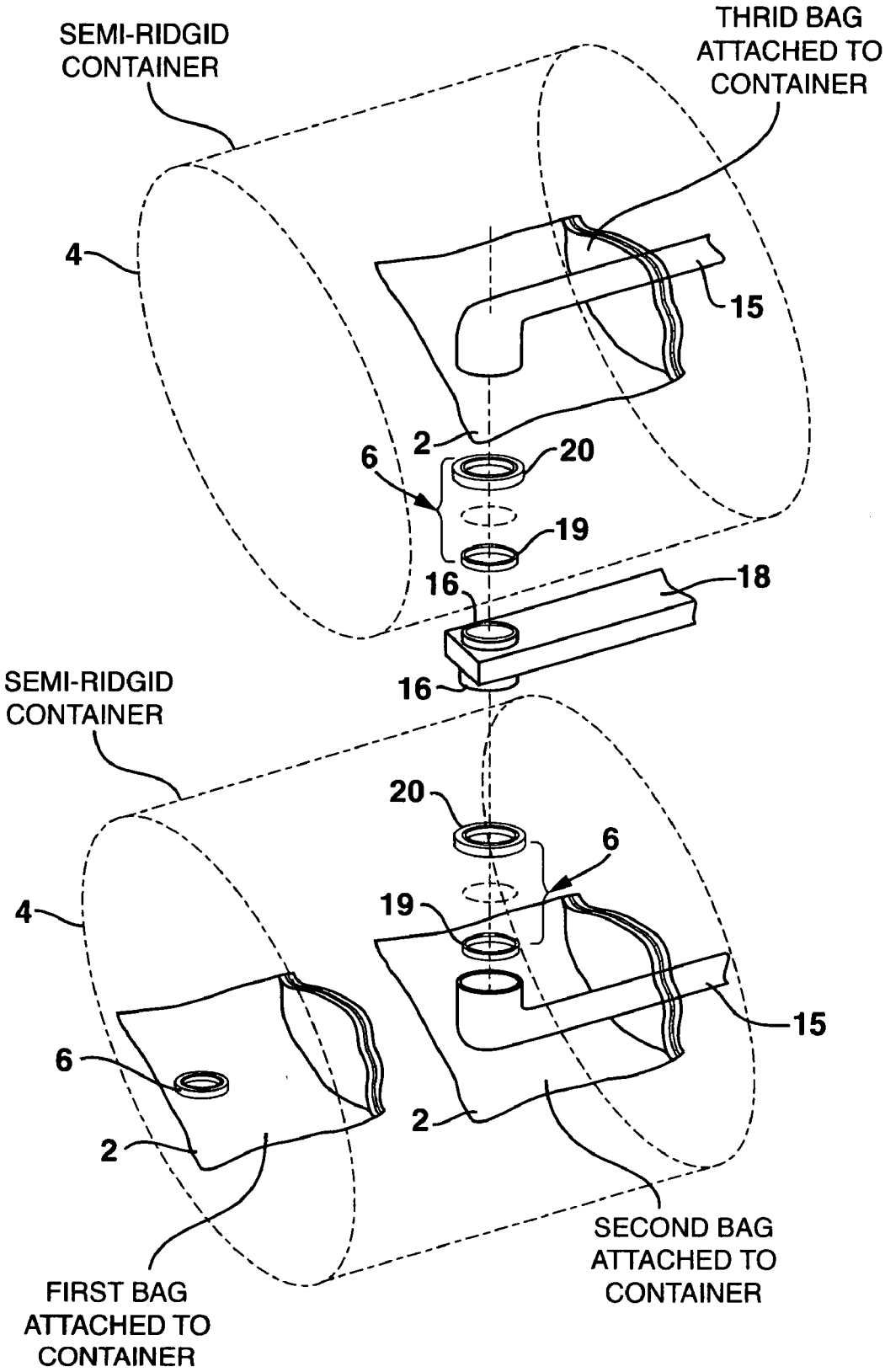
FIG. 31 is a perspective view of an embodiment incorporating a semi-rigid container
Figure 32:
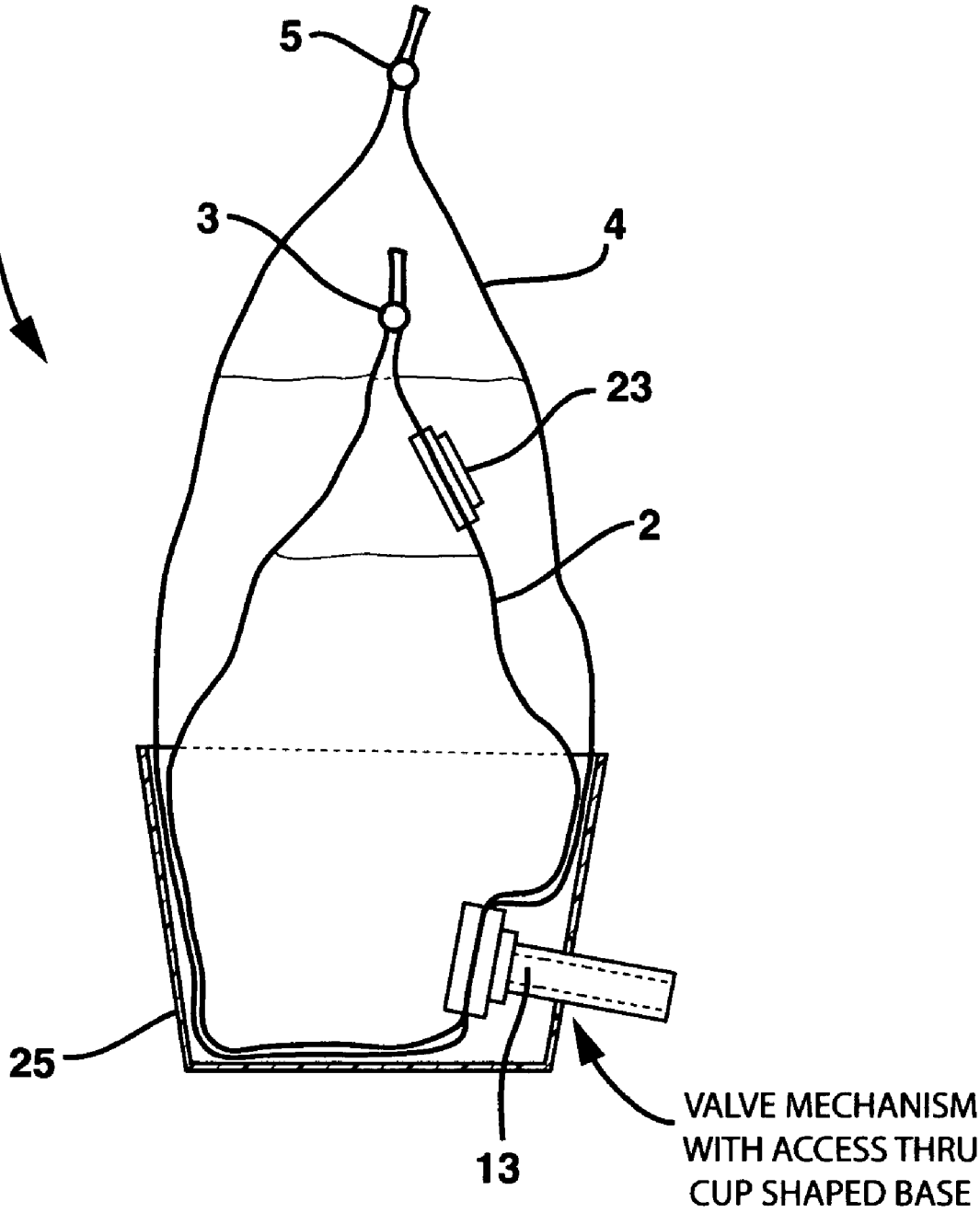
FIG. 32 is a side view of an embodiment incorporating semi rigid base

The portable, liquid-dispensing bag 1 comprises: one or more inner bags 2 constructed of a first flexible liquid proof material and having a first re-sealable opening 3, an outer bag 4 constructed of a second flexible liquid proof material and having a second re-sealable opening 5, and a fitment portal 6 connecting said inner bag 2 to said outer bag 4 in a liquid proof manner and passing through both said inner bag 2 and said outer bag 4 to provide a passage from the inside of said inner bag 2 to the outside of said outer bag 4. In one embodiment the portable, liquid-dispensing bag 1 comprises a single inner bag 2 and a single outer bag 4 wherein both the inner bag 2 and the outer bag 4 are attached in a liquid-proof manner to a single fitment portal 6 permitting flow of liquid from inside the inner bag 2 to the outside of the outer bag 4. In another embodiment of the portable, liquid-dispensing bag 1 the inner bag 2 or bags 2 and the outer bag 4 are attached in a liquid proof manner to form a fitment portal 6 through which a tap or spigot of a liquid container, such as a wine box, bag or other flexible container, may pass allowing liquid from the container to be removed via the tap or spigot to the outside of the outer bag 4. The inner bag 2 may or may not include one or more re-sealable openings 3 to permit insertion of other containers 8, or materials 9 as desired. The inner bag 2 may be of seamless construction as shown in FIGS. 2, 3, 7, 11, 12, 13 ,14 and 32. The outer bag 4 may or may not include one or more second re-sealable openings 5 to permit insertion of other containers 8, or materials 9 as desired. The inner bag 2 and the outer bag 4 may be composed of the same or differing materials, provided that the materials chosen are capable of being sealed to either each other to form a fitment portal 6 or to the fitment portal 6 in a liquid-proof manner, such as heat sealing, adhesive fastening, stretch fitting or other suitable means.

The outer bag 4 may be of a semi-rigid material. In some embodiments a cup shaped base may be employed to provide a stable base for the portable, liquid dispensing bag 1. When such a base is employed it also may be fitted with fitment portals 6, taps 12, or holes for these as required to provide stable positioning of the portable liquid-dispensing bag 1. The outer bag 4 may be of seamless construction as shown in FIGS. 2, 3, 7, 11, 12, 13, 14 and 32.

In one embodiment the fitment portal 6 comprises a first ring 19 and second ring 20 with Said first ring 19 disposed interior to at least one inner 2 or one outer bag 4, and said second ring 20 disposed outside at least one inner bag 2 or one outer bag 4. Said first ring 19 and second ring 20 may be sized and formed such that they form a snap-together fitment portal for applications where heat or adhesive attachment may be unsuitable.

In use, the space 10 between the inner bag 2 and the outer bag 4 may be filled or partly filled with chilled material, warmed material, or insulating materials chosen to maintain the contents of the inner bag 2 at a chosen temperature without the contents of the inner bag 2 and the contents of the space 10 between the inner and outer bags 4 comingling or otherwise cross contaminating the respective contents. In some contemplated embodiments the adjacent spaces 10 between inner bags 2 or between inner bags 2 and outer bags 4 may be filled with differing materials which, when mixed through a temporarily sealed opening, react to produce heat or cooling.

In other embodiments the outer bag 4 may be fitted with a second fitment portal 11 or tap 12 to permit the contents of the space 10 between the inner bag 2 and outer bag 4 to be drained from the outer bag. In an exemplary application, wine, or soft drinks may be placed within the inner bag 2 and kept cool by placing ice made from a potable liquid in the space 10 between the inner bag 2 and the outer bag 4. The proximity of the ice to the potable liquid within the inner bag 2 permits cooling of the potable liquid in the inner bag 2. As heat is absorbed by the portable, liquid-dispensing bag 1 the ice in the space 10 between the inner bag 2 and the outer bag 4 will melt and provide a reservoir of potable liquid in the space 10 between the inner-bag 2 and the outer bag 4 which may be withdrawn through a second fitment portal 11 fitted to the outer bag 4. It will be appreciated that the two potable liquids may be the same or different potable liquids in other uses of the portable, liquid-dispensing bag 1. It will be further appreciated that either or both of the two liquids may not be potable.

It will now be appreciated that a plurality of taps 12 may be affixed to any inner bag 2 or the outer bag 4. Further, taps 12 and fitment portals 6 chosen of such relative sizes and configurations such that any inner bag 2 fitted with a tap 12 or taps 12 may have these taps 12 concealed within an outer bag 4 or another inner bag 2. In this configuration it is also possible to reposition the inner bag 2 to allow one of the taps 12 affixed to it to protrude through a fitment portal 6 in the surrounding inner 2 or outer bag 4. In additional embodiments the fitment portal 6 may further comprise a closable cover 24 which could be used to prevent contamination of a tap 12, valve mechanism 13, an inner bag 2, or anything contained within the outer bag 4 by sand, dirt, microbes, chemicals, or any other undesirable materials.

The fitment portal 6 provides an attachment area where one or more inner bags 2 and an outer bag 4 may be attached in a liquid-proof manner to provide a path for liquids contained within the inner bag 2 or within the space between the inner bag 2 and the outer bag 4 to be drained to the outside of the outer bag 4.

In some embodiments the fitment portals 6 may include valve mechanisms 13 of varying complexity. These valve mechanisms serve to allow fluids to pass through the fitment portal 6 to the outside of the outer bag 4 and to interrupt that flow through action of the user. In other embodiments the valve mechanism may consist of a simple stopper. In yet other instances, the fitment portal 6 may be configured to seal to the outside of a spigot, or faucet of a vessel containing potable liquid. In some embodiments the inner bag 2 or bags 2 may be fitted with a gas vent 23 to permit release of air or other gasses trapped within said inner bags 2. In some embodiments the outer bag 4 may be fitted with a gas vent 23. This gas vent 23 may be a one-way vent.

In embodiments involving more than one inner bag 2 it will be appreciated that additional inner bags 14 may be configured within other inner bags 2 or additional inner bags 14 in a sequence of bags configured in an onion-like arrangement with any number of additional inner bags 2. In these embodiments any combination of bags may be sealed together about a fitment portal 6 to provide egress for liquids contained within any specific inner bag 2 or additional inner bag 14 and the outside of the outer bag 4. In another class of embodiments a number of inner bags 2 may be enclosed within an outer bag 4, and the fitment portals 6 configured to provide egress for liquids from within any of the inner bags 2 to the outside of the outer bag 4. It will now be apparent that many combinations of these two embodiments are possible. For example a portable, liquid-dispensing bag 1 may be constructed of an outer bag 4, two inner bags 2, and an additional inner bag 14 within each of the inner bags 2.

It may now be appreciated that the portable, liquid-dispensing bag 1 may be used in any application where mixing of any number of liquids or fluids contained within the various chambers formed within the portable, liquid-dispensing bag 1 is undesirable.

It will be further understood that inner bags 2 and the outer bag 4 can be provided with fitment portals 6, taps 12, valve mechanisms 13, or other devices such as weakened areas in the bag material permitting the materials present in selected chambers to mix when the user desires to achieve the effect such mixing would produce. Said chambers result from the selection and relative positioning of a number of inner bags 2 and an outer bag 4. Typically, the mixing of fluids to produce heating, cooling or other effects results from intentional rupturing of a bag provided with a weakened area.

The portable, liquid-dispensing bag 1 may be constructed in a number of ways. One such way comprises first making the necessary holes and creating or attaching the desired fitment portals 6, taps 12, and other seals in sheet material 21 and then forming the sheet material 21 into portable, liquid-dispensing bags 1 by cutting folding, and/or sealing the sheets as required. This method of making the portable, liquid-dispensing bag comprises the steps: (a) configuring a base 18 with a set of bonding positions 16, (b) configuring a set of vacuum arms 15 with a set of cutting positions 17, where at least one of said cutting positions 17 is placed opposite to and in alignment with at least one of said bonding positions 16, (c) placing one or more sheets of material between said set of vacuum arms 15 and said base 18, (d) moving said set of vacuum arms 15 and said base 18 causing said corresponding cutting positions 17 and said bonding positions 16 to effect one or more holes in said sheets of material 21, (e) forming each of said sheets of material 21 into either one or more of said inner bags 2 or one or more outer bags 4.

Another method of constructing the portable, liquid-dispensing bag 1 comprises first creating the inner bags 2 and an outer bag 4, then placing the necessary holes, fitment portals 6, taps 12, and seals in and among the inner bags 2 and the outer bag 4. This method of making the portable, liquid-dispensing bag 1 comprises the steps: (a) configuring a base 18 with a set of bonding positions 16, (b) configuring a set of vacuum arms 15 with a set of cutting positions 17, where at least one of said cutting positions 17 is placed opposite to and in alignment with at least one of said bonding positions 16, (c) placing one outer bag 4 between said set of vacuum arms 15 and said base 18 with either said set of vacuum arms 15 or said base 18 within said outer bag 4, (d) placing one or more inner bags 2 between said set of vacuum arms 15 and said base 18 with either said set of vacuum arms 15 or base 18 within said inner bags 15 with said inner bags 2 placed within said outer bag 4, (e) moving said set of vacuum arms 15 and said base 18 causing said cutting position 17 and bonding positions 16 to effect one or more holes in the inner bags 2 and the outer bag 4 placed between said set of vacuum arms 15 and said base 18. The liquid proof seals are formed by any suitable means including, but not limited to, pressure fitting or heat sealing. Heat sealing would be accomplished by the inclusion of fusers 22 either on the cutting positions 16 or the bonding positions 17 or both.

The set of vacuum arms 15 and base are efficiently used when all the layers of bag material between the innermost of the inner bags 2 and the outside of the outer bag 4 are cut and sealed at the same time.

It will be appreciated that any number of bonding positions 16 may be present and used on a single base 18 and that any number of cutting positions 17 may be present and used on a single set of vacuum arms 15. It will also be appreciated that said bonding positions 16 may be placed anywhere on the base 18 and any number of said cutting positions 17 may be placed on a set of vacuum arms 15 that efficiency in the manufacture of the portable, liquid-dispensing bag 1 may dictate and that multiple set of vacuum arms 15 may be employed in the construction of portable, liquid-dispensing bags 1 or in the simultaneous manufacture of two or more such bags 1 of differing configurations. It will also be appreciated that a number of dissimilar portable, liquid-dispensing bags 1 may be manufactured simultaneously employing set of vacuum arms 15 and bases 18 of differing configurations.

I claim:

1. A portable, liquid-dispensing bag comprising:

(a) an outer bag constructed of a flexible liquid proof material and having a second re-sealable opening, (b) one or more inner bags constructed of a flexible liquid proof material having a second reseaelable opening;

(c) a fitment portal for connecting said outer bag in a liquid proof manner to a one or more inner bags; and (d) an other container, said other container fitted with a tap, said fitment portal sized to accommodate passage of said tap therethrough.

2. The portable, liquid-dispensing bag of claim 1 further comprising a resealable tap to permit liquids present in said outer bag to be drained from said outer bag.

3. The portable, liquid-dispensing bag of claim 1 wherein said fitment portal is configured to form a liquid proof chamber around a container.

4. The portable, liquid-dispensing bag of claim 1 further comprising a rigid external container.

5. The portable, liquid-dispensing bag of claim 1 further comprising a plurality of temporarily sealed openings in one or more inner bags to permit fluid to move through the surface defined by said inner bag.

6. The portable, liquid-dispensing bag of claim 1 wherein said fitment portal comprises a first ring and a second ring.

7. The portable, liquid-dispensing bag of claim 1 wherein one or more of said inner bags further comprises a resealable gas vent.

8. A portable, liquid-dispensing bag comprising:

(a) one or more inner bags constructed of a first flexible liquid proof material and having first re-sealable opening, (b) an outer bag constructed of a second flexible liquid proof material and having a second re-sealable opening, and (c) a fitment portal connecting said inner bag to said outer bag in a liquid proof manner and passing through both said inner bag and said outer bag to provide a passage from the inside of said inner bag to the outside of said outer bag, and (d) one or more additional inner bags and one or more fitment portals connecting said additional inner bags to said outer bag in a liquid proof manner and passing through said additional inner bag, said inner bag and said outer bag to provide a passage from the inside of said additional inner bag to the outside of said outer bag.

9. The portable, liquid-dispensing bag of claim 8 further comprising a rigid external container.

10. The portable, liquid-dispensing bag of claim 8 further comprising a plurality of temporarily sealed openings in one or more inner bags to permit fluid to move through the surface defined by said inner bag.

11. The portable, liquid-dispensing bag of claim 8 wherein said fitment portal comprises a first ring and a second ring.

12. The portable, liquid-dispensing bag of claim 8 wherein one or more of said inner bags further comprises a resealable gas vent.

13. The portable, liquid-dispensing bag of claim 8 further comprising a resealable tap to permit liquids present in said outer bag to be drained from said outer bag.

* * * * *